US007155882B2

(12) United States Patent
Ghini et al.

(10) Patent No.: US 7,155,882 B2
(45) Date of Patent: Jan. 2, 2007

(54) METHOD OF PRODUCING A HINGED-LID WALLET PACKET

(75) Inventors: Marco Ghini, Monte San Pietro (IT); Stefano Negrini, Calderara Di Reno (IT)

(73) Assignee: G.D Societa' Per Azioni, Bologna (IT)

( * ) Notice: Subject to any disclaimer, the term of this patent is extended or adjusted under 35 U.S.C. 154(b) by 6 days.

(21) Appl. No.: 11/177,737

(22) Filed: Jul. 8, 2005

(65) Prior Publication Data

US 2006/0010838 A1 Jan. 19, 2006

(30) Foreign Application Priority Data

Jul. 12, 2004 (IT) ..... BO2004A000434

(51) Int. Cl.
*B65B 19/04* (2006.01)
*B65B 19/22* (2006.01)

(52) U.S. Cl. ..... 53/444; 53/148; 53/234; 53/464

(58) Field of Classification Search ..... 53/444
See application file for complete search history.

(56) References Cited

U.S. PATENT DOCUMENTS 1,795,666 A * 3/1931 Molins ..... 53/443
3,884,013 A 5/1975 Solomon
4,095,396 A * 6/1978 Seragnoli ..... 52/234
4,308,708 A * 1/1982 Focke ..... 53/136.4
4,617,780 A * 10/1986 Focke et al. ..... 53/466
4,918,908 A 4/1990 Focke et al.
5,590,763 A 1/1997 Focke et al.
5,755,080 A * 5/1998 Draghetti et al. ..... 53/466
5,983,595 A * 11/1999 Focke et al. ..... 53/234
6,612,094 B1 9/2003 Bailey et al.
6,694,703 B1 * 2/2004 Grossmann et al. ..... 53/228
6,941,728 B1 * 9/2005 Bray et al. ..... 53/449

FOREIGN PATENT DOCUMENTS

GB 367111 2/1932

* cited by examiner

*Primary Examiner*—John Sipos
(74) *Attorney, Agent, or Firm*—Marshall, Gerstein & Borun LLP

(57) ABSTRACT

A method of producing a wallet packet with a hinged lid, whereby a blank, having a first portion defining a body and a second portion defining a hinged lid of a relative wallet packet, is fed into a respective pocket, having a respective pair of side by side seats, of a packing wheel, so that the relative first portion defines two adjacent receptacles separated by a central rib; and wherein the pocket is fed through a loading station, where the two receptacles simultaneously receive respective wrapped groups of cigarettes; one of the two receptacles then being turned over onto the other to define the body of the relative wallet packet.

14 Claims, 2 Drawing Sheets

METHOD OF PRODUCING A HINGED-LID WALLET PACKET

CROSS-REFERENCE TO RELATED APPLICATION

This application claims the benefit of Italian patent application number BO2004A 000434, filed Jul. 12, 2004.

BACKGROUND OF THE INVENTION

The present invention relates to a method of producing a hinged-lid wallet packet, i.e. a packet of the type described in WO-8808602 and comprising a cup-shaped body and a lid. The body is in the form of a rectangular parallelepiped bounded by a major front wall and a major rear wall, the lid being hinged to the rear wall; by a bottom wall cut longitudinally into two coplanar halves; and by a first and a second minor lateral wall, of which the first is cut longitudinally into two coplanar halves, and the second is a continuous wall.

The body is therefore defined by a first and a second receptacle, which are connected to each other by a longitudinal hinge extending along a central longitudinal portion of the second minor lateral wall, and have respective bottom walls defined by the front wall and rear wall of the body respectively. The receptacles house respective wrapped groups of cigarettes having respective collars, and are movable, when the lid is open, between a closed position, in which the receptacles are superimposed and opposite each other, and the collars are positioned contacting each other, and an open position, in which the second minor lateral wall is folded book-fashion about the longitudinal hinge to define a central longitudinal rib separating the two receptacles, and the collars face outwards and are coplanar with each other and with the longitudinal hinge.

SUMMARY OF THE INVENTION

It is an object of the present invention to provide a straightforward, low-cost method of producing a wallet packet of cigarettes of the type described above.

According to the present invention, there is provided a method of producing a hinged-lid wallet packet, as claimed in the attached claims.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 2:
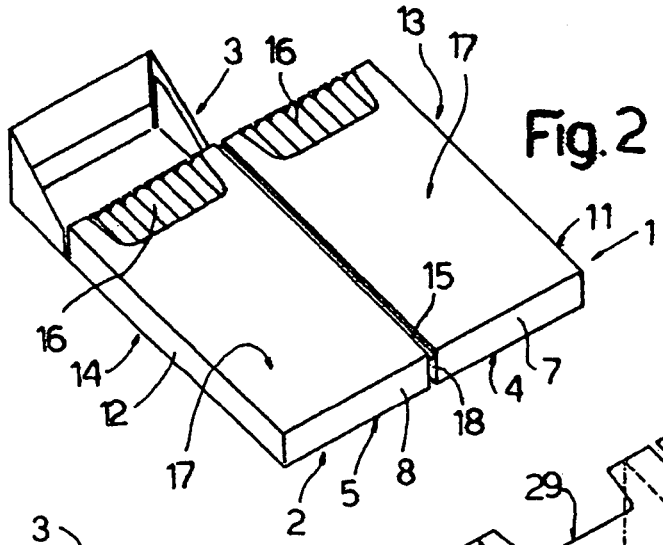
FIGS. 1, 2 and 3 show, respectively, closed, open, and exploded views in perspective of a first wallet packet.
Figure 1:
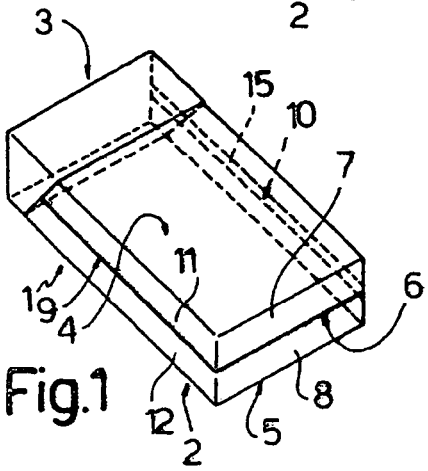
Figure 3:
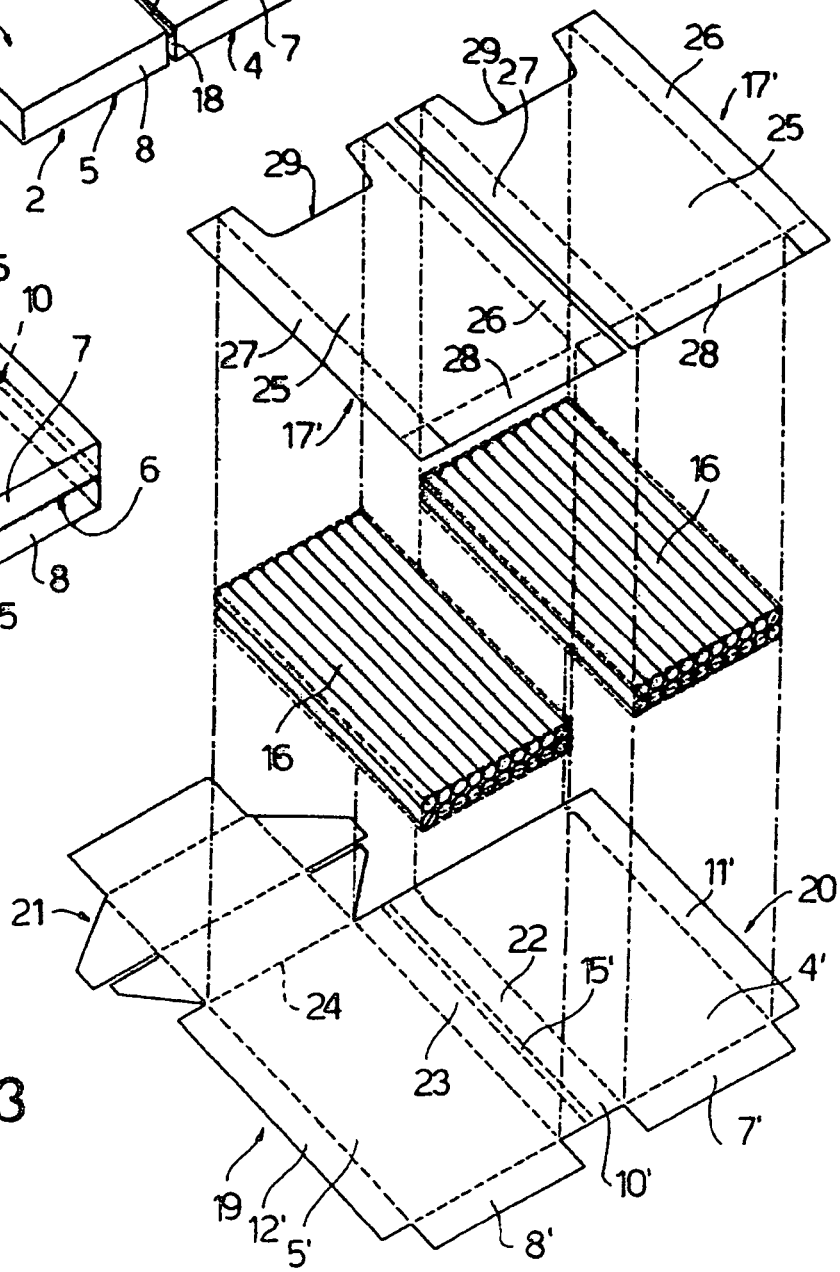

With reference to FIGS. 1 to 3, number 1 indicates as a whole a wallet packet of cigarettes comprising a cup-shaped body 2 and a lid 3. Body 2 is in the form of a rectangular parallelepiped bounded by a major front wall 4 and a major rear wall 5, lid 3 being hinged to rear wall 5; by a bottom wall 6 cut longitudinally into two coplanar halves 7 and 8; and by a first and a second minor lateral wall 9 and 10, of which lateral wall 9 is cut longitudinally into two identical coplanar halves 11 and 12, and lateral wall 10 is a continuous wall.

Body 2 is defined by a first receptacle 13 and a second receptacle 14, which are connected to each other by a hinge strip 15 extending along a longitudinal axis of lateral wall 10, and have respective bottom walls defined by front wall 4 and rear wall 5 of body 2 respectively. Receptacles 13 and 14 house respective identical wrapped groups 16 of cigarettes having respective identical collars 17 integral with respective receptacles 13 and 14, and are movable, when lid 3 is open, between a closed position, in which receptacles 13 and 14 are superimposed and opposite each other, and collars 17 are positioned contacting each other, and an open position, in which receptacles 13 and 14 are coplanar, lateral wall 10 is folded book-fashion about hinge strip 15 to define a central longitudinal rib 18 separating the two receptacles 13 and 14, and the two collars 17 face outwards.

With reference to FIG. 3, body 2 and lid 3 are formed by folding a flat blank 19, a portion 20 of which defines body 2, and a standard portion 21 of which defines lid 3 and is not described in detail.

Portion 20, the component parts of which are indicated, for the sake of simplicity, using the same reference numbers, with superscripts, as for the corresponding walls of wallet packet 1, comprises two main panels 4' and 5' connected laterally to each other by a central panel 10', along which two central longitudinal fold lines define a central strip 15', and two identical lateral wings 22, 23 located on opposite sides of central strip 15', and of which lateral wing 22 is integral with a lateral edge of main panel 4', and lateral wing 23 is integral with a lateral edge of main panel 5'.

Main panel 4' is also connected to a lateral wing 11' opposite and identical with lateral wing 22, and to an end wing 7' of the same width as lateral wings 11' and 22; and main panel 5' is connected to a lateral wing 12' opposite and identical with lateral wing 23, to an end wing 8' aligned with end wing 7' and of the same width as lateral wings 12' and 23, and to portion 21, which is located at the opposite end of main panel 5' to end wing 8', and is connected to main panel 5' along a hinge line 24.

Each collar 17 is formed from a flat blank 17' (FIG. 3) comprising a substantially rectangular central panel 25, which is substantially the same width as main panels 4' and 5' and has two opposite lateral wings 26 and 27 and an end wing 28. At the opposite end to end wing 28, each central panel 25 has a recess 29.

Figures 4, 5:
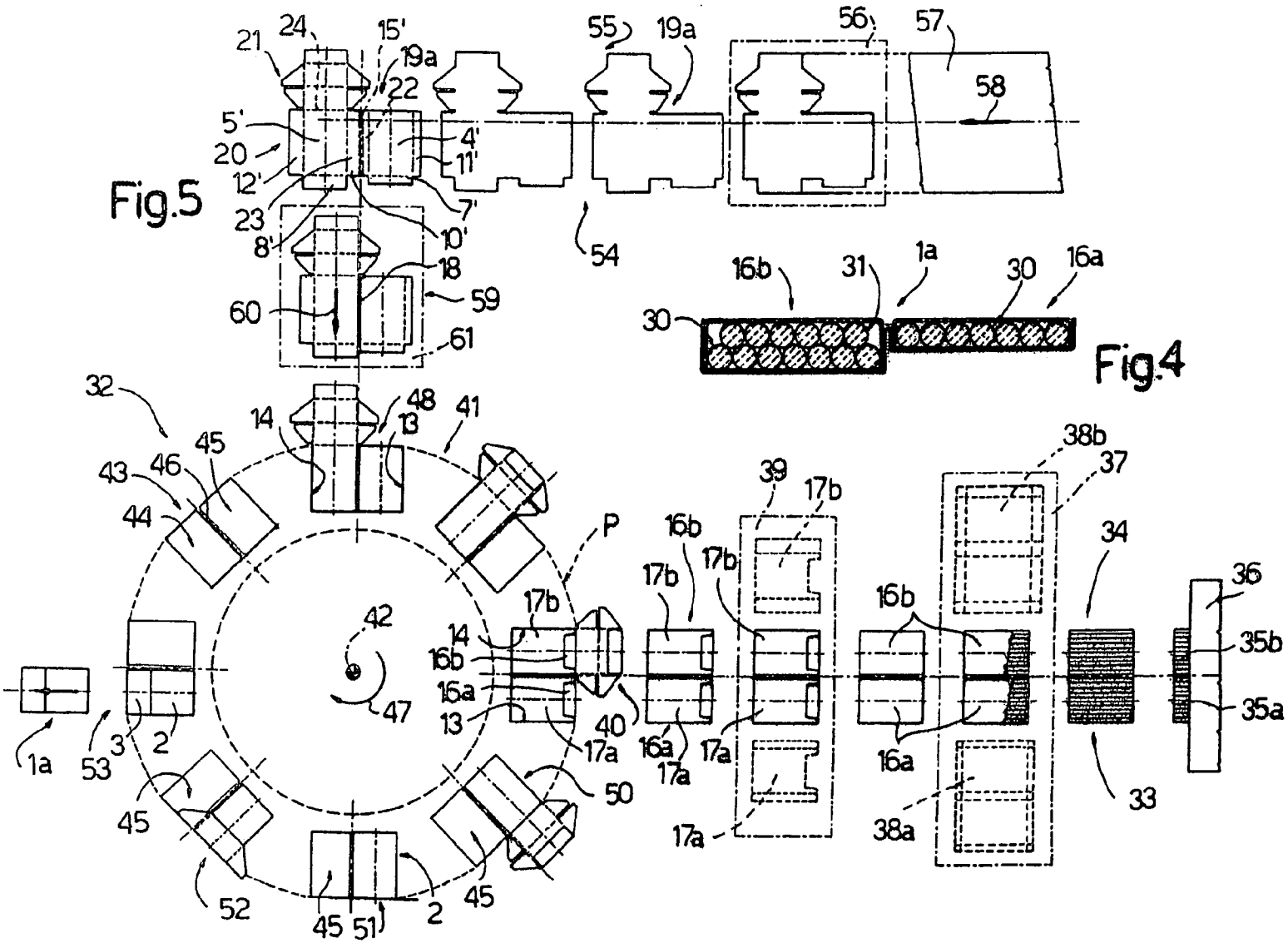
FIG. 4 shows a cross section of a variation of the FIG. 2 packet.
FIG. 5 shows a schematic plan view, partly in block form and with parts removed for clarity, of a preferred embodiment of a packing machine for producing the wallet packet in FIGS. 1–3 or in FIG. 4 using the method according to the present invention.

FIG. 4 shows a packet 1*a*, which is similar to packet 1, is formed from a blank 19*a* (FIG. 5) similar to blank 19, but differs from packet 1 by wrapped groups 16 of cigarettes—hereinafter indicated 16*a* and 16*b*—being identical in plan but of different thicknesses, and by relative receptacles 13 and 14 also being identical in plan but of different thicknesses. More specifically, group 16*a* is defined by only one layer 30 of, in the example shown, seven cigarettes, whereas group 16*b* is twice the thickness of group 16*a*, and is defined, in the example shown, by two superimposed layers 30 and 31, of which layer 30 comprises seven cigarettes, like layer 30 of group 16*a*, while layer 31 comprises only six cigarettes offset with respect to those in adjacent layer 30. Similarly lateral wings 23 and 12' and end wing 8' of blank 19*a* are of the same width, which is twice the width of relative lateral wings 22 and 11' and end wing 7, so that receptacle 14 is twice as deep as receptacle 13. Finally, collars 17, indicated 17*a* and 17*b* in FIG. 5, preferably differ, so as to adapt to the different thicknesses of relative groups 16*a* and 16*b*. Alternatively, in a variation not shown, collars 17*a* and 17*b* are identical, and collar 17*b* only partly encloses relative group 16.

With reference to FIG. 5, number 32 indicates a packing machine for producing a succession of packets 1 or 1*a*. In the example shown, packing machine 32 is set to produce packets 1*a*.

Packing machine 32 comprises two feed lines 33 and 34 for receiving respective successions of relative groups 35*a* and 35*b* of cigarettes from a known forming device 36, and for feeding relative groups 35*a* and 35*b* of cigarettes through a known packing device 37, where each group 35*a*, 35*b* of cigarettes is formed in known manner into a corresponding wrapped group 16*a*, 16*b* of cigarettes by wrapping group 35*a*, 35*b* of cigarettes in a respective sheet 38*a*, 38*b* of foil.

Along relative feed line 33, 34, each wrapped group 16*a*, 16*b* of cigarettes from packing device 37 is fed through a further known packing device 39, where each wrapped group 16*a*, 16*b* of cigarettes is provided with a respective collar 17*a*, 17*b*, and then to a loading station 40 of a packing wheel 41 rotating in steps about a vertical axis 42 crosswise to feed lines 33 and 34. Feed lines 33 and 34 are timed with each other, so that each wrapped group 16*a* of cigarettes travelling along line 33 reaches loading station 40 together, and side by side, with a corresponding wrapped group 16*b* of cigarettes travelling along line 34.

As shown in FIG. 5, packing wheel 41 has, along its outer periphery, a succession of pockets 43 equally spaced about axis 42. Each pocket 43 is divided, by an intermediate rib 46 extending radially with respect to axis 42, into two side by side seats 44 and 45, which are identical in plan, but of which seat 44 is twice the depth of seat 45 and approximately the same depth, but no shallower, than a receptacle 14.

Packing wheel 41 is connected to a known motor (not shown) to rotate, clockwise in FIG. 5, in steps about axis 42 to feed pockets 43 in a travelling direction 47 along an annular packing path P extending through a loading station 48 for loading flat blanks 19*a* inside relative pockets 43, and through loading station 40, where, at each stop of packing wheel 41, a wrapped group 16*a* of cigarettes is fed by feed line 33 into a relative receptacle 13, and, at the same time, a wrapped group 16*b* of cigarettes is fed by feed line 34 into a relative receptacle 14 of the same packet 1*a*. Downstream from loading station 40 in travelling direction 47, packing path P extends through a turn-over station 50 for turning each receptacle 13 over onto relative receptacle 14; two folding stations 51 and 52 for folding portion 21; and an unloading station 53 where packets la are completed and fed onto an output conveyor (not shown).

As shown in FIG. 5, flat blanks 19*a* are fed to loading station 48 by a feed line 54 comprising an input portion 55, along which a known punch device 56 forms flat blanks 19*a* successively from a continuous strip 57 supplied in a direction 58 parallel to feed lines 33, 34 and crosswise to central strips 15' of flat blanks 19*a*; and an output portion 59 extending in a direction 60 crosswise to direction 58 and radial with respect to packing wheel 41, and along which flat blanks 19*a* are fed, parallel to central strips 15', through a known folding device 61, in which a folding blade (not shown), located over feed line 54, engages each flat blank 19' along respective central strip 15' to form respective central rib 18.

Once respective central rib 18 is formed, each flat blank 19*a* is fed, at loading station 48, onto a respective pocket 43, and is pressed inside pocket 43 to form, inside seats 44 and 45, receptacles 14 and 13, into which respective wrapped groups 16*b* and 16*a* of cigarettes, together with respective collars 17*b* and 17*a*, are inserted at loading station 40.

At the next turn-over station 50, receptacle 13, containing respective wrapped group 16*a* of cigarettes and respective collar 17*a*, is turned over, by a known turn-over device (not shown), onto relative receptacle 14 housing respective wrapped group 16*b* of cigarettes and respective collar 17*b*, so that the two collars 17*a* and 17*b* are positioned contacting each other, thus completing body 2 of relative packet 1*a*, the lid 3 of which is completed at the following folding stations 51 and 52.

The structure and operation of a packing machine (not shown) for producing packets 1 will be clear from the foregoing description, with no further explanation required. Suffice it to say that, on such a machine, feed lines 33 and 34 are identical, as are groups 35 of cigarettes, sheets 38, collars 17, receptacles 13 and 14, and seats 44 and 45.

The invention claimed is:

1. A method of producing a hinged-lid wallet packet, whereby a blank (19; 19*a*), having a first portion (20) defining a body (2) and a second portion (21) defining a hinged lid (3) of a relative wallet packet (1; 1*a*), is fed into a respective conveyor pocket (43), having two side by side seats (44, 45), so that the relative first portion (20) defines two adjacent receptacles (13, 14) separated by a central rib (18) and each housed inside a respective said seat (45; 44); the pocket (43) then being fed in a given travelling direction (47) and along a packing path (P) through a loading station (40), where the two receptacles (13, 14) simultaneously receive respective wrapped groups (16; 16*a*, 16*b*) of cigarettes, and through a following turn-over station (50), where one of the two receptacles (13, 14) is turned over onto the other to define the body (2) of the relative wallet packet (1; 1*a*).

2. A method as claimed in claim 1, and comprising the steps of forming a succession of pairs of first and second groups (35; 35*a*, 35*b*) of cigarettes; and feeding said first groups (35; 35*a*) and said second groups (35; 35*b*) of cigarettes to said loading station (40) by means of a first and a second feed line (33, 34) respectively; each said group (35; 35*a*; 35*b*) of cigarettes, as it travels along the relative said feed line (33; 34), being wrapped in a relative sheet (38; 38*a*; 38*b*) to form a relative said wrapped group (16; 16*a*; 16*b*) of cigarettes.

3. A method as claimed in claim 1, and comprising the further step of folding said second portion (21) about the superimposed said first and said second receptacle (13, 14) to form the hinged lid (3).

4. A method as claimed in claim 2, wherein said feed lines are parallel and adjacent to each other to feed the wrapped groups (16; 16*a*, 16*b*) of cigarettes in successive and adjacent locations along said packing path (P).

5. A method as claimed in claim 4, wherein said feed lines (33, 34) are parallel and adjacent to each other to simultaneously feed the wrapped groups (16; 16*a*, 16*b*) of cigarettes in successive and adjacent locations along said packing path (P) and at said loading station (40).

6. A method as claimed in claim 1, and comprising the further step of providing each said wrapped group (16; 16*a*; 16*b*) of cigarettes with a respective collar (17; 17*a*; 17*b*) upstream from said turn-over station (50).

7. A method as claimed in claim 2, wherein each said wrapped group (16; 16*a*; 16*b*) of cigarettes is provided with the respective collar (17; 17*a*; 17*b*) as the wrapped group (16; 16*a*; 16*b*) of cigarettes travels along the relative feed line (33; 34).

8. A method as claimed in claim 1, wherein said central rib (18) is formed on said blank (19; 19*a*) along a feed line (54) for feeding the blank (19; 19*a*) onto said packing path (P).

9. A method as claimed in claim 1, wherein the packing path (P) is a circular path extending about an axis (42).

10. A method as claimed in claim 1, wherein turn-over of one of the receptacles (13, 14) onto the other is performed by turning the leading receptacle (13), in said travelling direction (47), over onto the trailing receptacle (14) in said travelling direction (47).

11. A method as claimed in claim 1, wherein said groups (35) of cigarettes are identical.

12. A method as claimed in claim 1, wherein the groups (35*a*, 35*b*) of cigarettes of said wrapped groups (16*a*, 16*b*) of cigarettes are of different thicknesses.

13. A method as claimed in claim 12, wherein a first of said receptacles is located downstream from a second of said receptacles in said travelling direction; said second receptacle being connected to said second portion (21); and a thicker said wrapped group (16*b*) of cigarettes being fed into the second receptacle (14).

14. A method as claimed in claim 13, wherein the group (35*b*) of cigarettes of said thicker wrapped group (16*b*) of cigarettes comprises a superimposed first and second layer (30, 31) of cigarettes; the group (35*a*) of cigarettes of the other wrapped group (16*a*) of cigarettes comprising only said first layer (30) of cigarettes.

* * * * *